US006322067B1

(12) United States Patent
Fujii et al.

(10) Patent No.: US 6,322,067 B1
(45) Date of Patent: Nov. 27, 2001

(54) SHEET LOADING APPARATUS FOR IMAGE FORMING DEVICE

(75) Inventors: Michihiro Fujii; Wataru Miki, both of Hyogo (JP)

(73) Assignee: Fujitsu, Ltd., Kawasaki (JP)

( * ) Notice: Subject to any disclaimer, the term of this patent is extended or adjusted under 35 U.S.C. 154(b) by 0 days.

(21) Appl. No.: 09/456,471

(22) Filed: Dec. 9, 1999

(30) Foreign Application Priority Data

Dec. 18, 1998 (JP) ..... 10-361433

(51) Int. Cl.[7] ..... B65H 1/00

(52) U.S. Cl. ..... 271/145; 271/147; 271/157; 271/160; 271/169; 271/171

(58) Field of Search ..... 271/145, 147, 271/157, 160, 169, 171

(56) References Cited

U.S. PATENT DOCUMENTS 3,586,317 * 6/1971 Smitzer ..... 271/127
4,780,740 * 10/1988 Fukae ..... 399/86
5,238,238 * 8/1993 Shinohara et al. ..... 271/145
5,292,117 * 3/1994 Takagi et al. ..... 271/234
6,073,924 * 6/2000 Lin et al. ..... 271/147
6,135,443 * 10/2000 Yano .

* cited by examiner

*Primary Examiner*—Christopher P. Ellis
*Assistant Examiner*—Richard Ridley
(74) *Attorney, Agent, or Firm*—Armstrong, Westerman, Hattori, McLeland & Naughton, LLP

(57) ABSTRACT

A sheet cassette for an image forming apparatus supports a pivotally mounted sheet loading plate while giving a degree of freedom to the cassette tray by allowing a free end of the sheet loading tray to vertically move. Sheet guides for regulating the lateral position of sheets on the sheet loading tray are supported by the cassette tray and are aligned with apertures provided in the sheet loading plate, so that some play exists between the sheet guides and the cassette tray. Also, the problem that the sheets on the loading tray may run diagonally, or their printing position may be shifted laterally, when the sheet is fed from the cassette tray by the feed roller is overcome by the invention wherein a part of, or the entire sheet guides, are pivotally supported directly on the sheet loading plate so that each sheet guide is pivoted with respect to the sheet loading plate whereby, even when the sheet loading plate is moved upward, the sheet guides will not project outside the cassette tray but, instead, to the rear side of the sheet loading plate within the cassette tray. Apparatus is also provided for adjusting the fitting angle and the width direction position of the sheet loading plate.

6 Claims, 4 Drawing Sheets

7'
7
4
B
4b
E
8a
8
F
C
1
6b
6a
7a
4a 7
7a
8a
8b
8
4b 5
10
12
11
7
9
14
4b
15

SHEET LOADING APPARATUS FOR IMAGE FORMING DEVICE

BACKGROUND OF THE INVENTION

1. Technical Field

The present invention relates to a sheet loading apparatus for loading and supporting the sheet, such as a document or a recording sheet to be supplied to an image forming apparatus as, for example, a printer, a copying machine, a facsimile, or the like.

2. Related Art

An image forming apparatus has generally been provided with a sheet feeding means for feeding a sheet to an image forming means of the apparatus and said sheet feeding means includes a sheet loading apparatus for loading and supporting the sheet.

The sheet loading apparatus is provided with a sheet cassette which can accommodate a plurality of sheets and can be loaded or unloaded to or from the apparatus body. The sheet cassette is comprised of a cassette tray having a vertically movable sheet loading plate wherein a feed roller mounted on the side of the apparatus body is operative to press the sheets loaded in the cassette and feed them from the cassette. A lateral positioning device for the sheets (sheet guides) is also provided for regulating the lateral positioning of the sheets in the width direction of the cassette.

This sheet guide device is provided at the bottom of the cassette tray and can have its position changed depending on the width of the sheets having different sizes by positioning the guides in cutout portions (apertures) formed in the sheet loading pate. However, the sheet loading apparatus of the related art has the following principle problems. The cutout portions (apertures), through which the width regulating members connected to the sheet loading plate extend, open to a great extent to change the position of the width regulating members to accommodate sheets of various sizes. Meanwhile, the sheet loading plate engages the cassette by means of a cutout portion provided at the bottom of the cassette tray wherein one end of the sheet loading plate is inserted in the cutout portion. Since a certain amount of play occurs with regard to this engagement, a certain amount of play also exists in the feeding direction of the sheet from the sheet loading plate and in the width regulating member provided at the bottom of the cassette tray. As a result, sheet discharges from the cassette diagonally or the sheet supply path is shifted in the width direction when the sheets loaded on the sheet loading plate are each moved upward for pressing to the feed roller and the sheet is transferred by the feed roller.

Moreover, even when the width regulating member is opened externally or tilted oppositely to the inside of the cassette tray, the printing position of a sheet is also shifted because the position in the width direction of sheets loaded on the sheet loading plate is displaced. However, since the width regulating member is provided on the cassette body, position adjustment has to be performed on the sheet loading apparatus fitting rail and stopper in order to prevent diagonal running and positional displacement of sheet, but here rises problems that the adjustment range is small and the rail structure is complicated. Moreover, a fitting position error of the sheet loading apparatus in an image forming apparatus also results in the problem that the sheet position in the lateral direction is shifted because the sheet feeding direction is at a right angle to the fitting direction of the sheet loading apparatus.

SUMMARY OF THE INVENTION

The present invention has been proposed considering the problems identified above and it is therefore an object of the present invention to provide a sheet loading apparatus which prevents diagonal running of the sheet by eliminating play between the sheet loading plate and a width regulating member to assure easier positioning for printing in the sheet width direction.

Moreover, it is also an object of the present invention to provide a sheet loading apparatus which prevents, when a number of sheet loading apparatus are stacked, a rise of the width regulating member so that a width regulating member, which has also moved upward together with the sheet loading plate, does not impinge on a superimposed sheet loading apparatus.

In order to attain the objects explained above, the invention according to a first aspect is characterized in that a part, or the entire part, of the width regulating means is supported directly by the sheet loading means in the sheet loading apparatus and consists of a sheet loading means provided at a side end portion of a sheet feeding means and arranged to be movable for pressing the loaded sheets to the sheet feeding means, and a width regulating means for regulating the position of the sheets in the width direction. Therefore, according to this first aspect of the invention, since the width regulating means is attached directly to the sheet loading means, play between the sheets and the width regulating means can be eliminated and diagonal running of sheets as a result of such play can be prevented.

According to a second aspect of the invention, the arrangement position of the width regulating means can be changed depending on the size of the various sheets used, such as B5, letter, A4, B4 and A3, etc.

According to a third aspect of the invention, the sheet loading apparatus comprising a sheet loading means having a side end portion of a sheet feeding means movable in order to press the loaded sheets sequentially to the sheet feeding means, and a width regulating means for regulating the position of sheets in the width direction, has a cutout portion in the sheet loading means through which each width regulating means passes, the rear end of the width regulating means is fitted to be pivotable in the upstream side of the sheet feeding direction within the cutout portion thus making substantially constant the height position of the front end of the width regulating means within the sheet loading apparatus on occasions when the sheet loading apparatus is moved in the upper and lower directions. Therefore, according to the invention, even when the sheet loading means moves upward, the downstream side in the sheet feeding direction of the width regulating means is never projected to the rear side from the cutout portion provided in the sheet loading means and the height position of the width regulating means is never projected significantly from the upper surface of the sheet loading apparatus, and moreover, even in cases in which the image forming apparatus uses many sheet loading apparatuses stacked upon each other, the bottom of a sheet loading apparatus never impinges on a lower width regulating means when the sheet loading apparatus is pulled out from the image forming apparatus.

Another aspect of the invention is characterized in that a plurality of cutout portions and fitting means are provided in the sheet loading means so that the fitting position of the width regulating means may be changed depending on the size of the sheets to be used.

According to another aspect of the invention the width adjusting means for moving the fitting position of the angle adjusting means in the sheet width direction is adjustable for laterally adjusting the position of the sheet loading means. Therefore, according to this aspect of the invention, the sheet feeding direction of the sheet loading means is adjusted by the angle adjusting means in order to prevent diagonal running of sheets from the cassette so that the end edges of the sheets become parallel to the axis of the resist roller disposed immediately before the transfer means in the image forming apparatus. Thus, it is possible to adjust the sheets to ensure that they impinge in parallel with the resist roller. Accordingly, the angular adjustment between the sheet loading apparatus and the image forming apparatus body by position adjustment of a fitting rail of the sheet loading apparatus which has heretofore been required in the related art, is no longer required.

Another aspect of the invention is characterized in that a width direction adjusting means for moving the fitting position of the angular adjusting means in the sheet width direction is provided for adjusting the position in the sheet width direction of the sheet loading means. Therefore, according to this aspect of the invention, even if the printing position of the sheet is a little deviated in the width direction, adjustment of the printing position by the width direction adjusting means may be effected easily.

According to another aspect of the invention, the sheet loading apparatus includes a sheet feeding means for feeding the loaded sheet from the sheet loading apparatus to an image forming means to form an image on the sheet being fed by the sheet feeding means. According to this aspect of the invention, there is provided an image forming apparatus which can easily prevent diagonal running of sheet and adjustment of the printing position of sheet.

For a better understanding of the invention, its operating advantages and the specific objectives obtained by its use, reference should be made to the accompanying drawings and description which relate to a preferred embodiment thereof.

PREFERRED EMBODIMENTS OF THE INVENTION

A first embodiment of the sheet loading apparatus of the present invention and an image forming apparatus loading the sheet loading apparatus will be explained with reference to the accompanying drawings.

Figure 5:
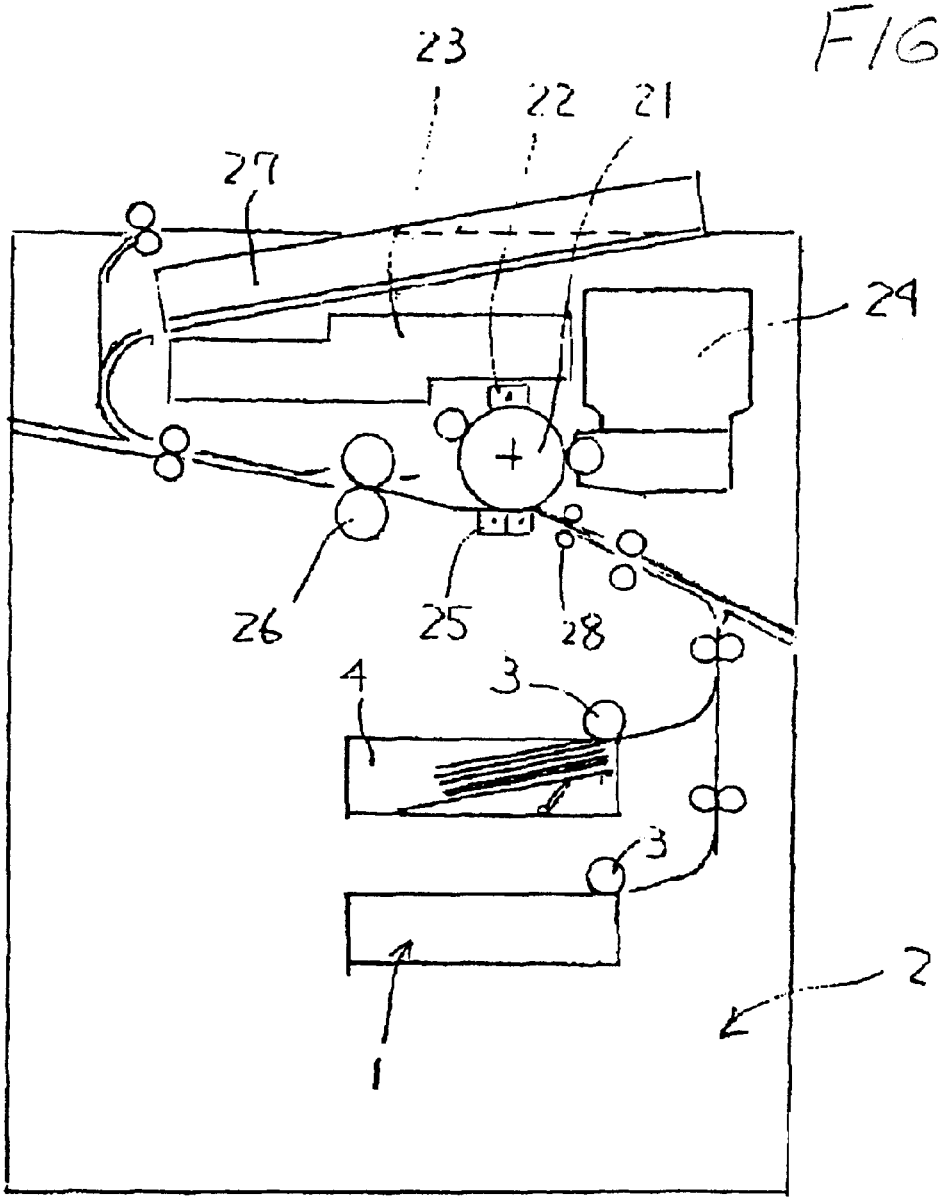
FIG. 5 is a cross-sectional view illustrating an example of an image forming apparatus containing a sheet loading apparatus according to the present invention.

FIG. 5 illustrates an image forming apparatus (printer) 2 which incorporates a sheet cassette 1 according to the present invention as a sheet loading apparatus. In the described embodiment, the image forming apparatus 2 accommodates two sheet cassettes which may provide sheets of the same or different sizes. The image forming apparatus 2, which is generally conventional, comprises a photosensitive drum 21 that is electrically charged by charger 22. An exposing unit 23 exposes the drum 21 to image light to form an electrostatic latent image thereon. A developing unit 24 supplies charged toners to the electrostatic latent image to provide a visible toner image. A transfer unit 25 transfers the toner image from the drum 21 to a sheet delivered from the sheet loading apparatus 1 along a path determined by guide rollers including a resist roller 28 located immediately upstream of the drum 21 and transfer unit 25. A fixing unit 26, which typically includes aheated roller, heats the sheet to fix the toner image thereon before passing the sheet to a stacker 27. Each sheet cassette 1 is loaded removably in the apparatus body of the image forming apparatus 2. When the sheet cassette 1 is loaded in the apparatus body, sheets therein are fed by a feed roller 3 provided on the side of the apparatus body.

Figure 1:
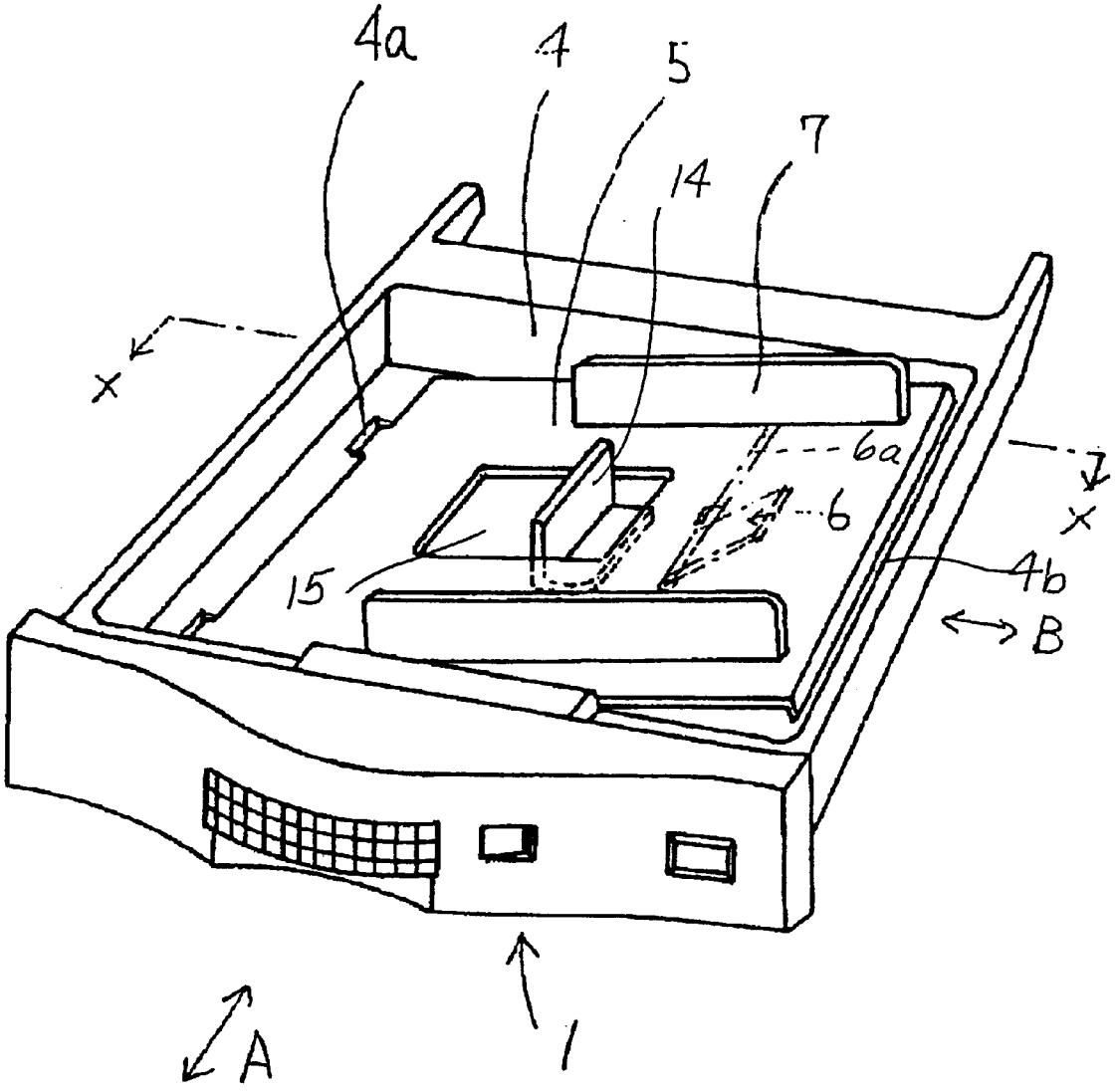
FIG. 1 is a perspective view illustrating an embodiment of the sheet loading apparatus of the present invention, wherein the sheet loading plate for loading the sheet is lifted upward.

With particular reference to FIG. 1 reference numeral 4 generally designates a cassette tray having a sheet loading plate 5 formed of a steel plate, which is lifted by a lifting mechanism 6 (indicated by broken lines because the lifting mechanism is disposed at a lower side of the sheet loading plate in the drawing figure) that cooperates with a driver provided within the image forming apparatus body to press the loaded sheet to the feed roller. Numeral 7 identifies a width regulating member, or side guide, which is directly supported by the sheet loading plate 5 for regulating the position in the width direction of the sheets loaded on the sheet loading plate 5.

The cassette tray 4 may be removably loaded in the direction A of FIG. 1 into the apparatus body along a rail (not shown) provided in the apparatus body. The feed roller 3 is arranged to feed a sheet from the cassette tray 4 in the direction B orthogonally crossing the loading direction of the cassette tray 4.

The sheet loading plate 5 is provided to be pivotable with its one end being pivotally engaged with a cutout portion 4*a* of the cassette tray 4 and its other, or free, end 4*b* (on the feed roller side) being liftable. The free end 4*b* is lifted by the lifting mechanism 6 to press the topmost of the loaded sheets on the sheet loading plate 5 to the feed roller 3. Moreover, the sheet loading plate 5 is provided with a pair of side guides 7 which are laterally adjustable depending on the width of the sheet on the loading plate 5 in order to regulate the position of the sheets. Also, a guide 14 extends through an opening 15 in the sheet loading plate 5 and operates to limit the rear ends of the sheets which have been loaded in the bottom of the cassette tray 4. The guide 14 is movable along the sides of the opening and can change the location of the sheets in the cassette tray 4 depending on the size of the installed sheets.

Therefore, by means of the sheet cassette of the structure as explained above, even when the free end 4*b* is lifted by the lifting mechanism 6 in order to press the topmost of the sheets loaded on the sheet loading plate 5 to the feed roller 3 at the time of sheet feeding, since the side guides 7 regulating the lateral position of the sheets go upward together with the sheet loading plate 5, the relative position between the sheets and the side guides does not change and thereby the diagonal running of sheets due to play between the side guides 7 and the sheets, which has been observed in the related art, can then be prevented.

As a result of the invention, printing in a printer containing the described sheet cassette can be realized without diagonal running of the sheets so that positional deviation of the sheet in the lateral direction is avoided when printing is conducted by a series of image-forming means transferring a toner image to the sheets fed sheet-by-sheet by the feed roller 3 by means of the photosensitive drum 21, the charger 22, the exposing unit 23, the developing unit 24 and the transfer unit 25, where the toner image is thereafter thermally fixed on the sheet by the fixing unit 26, followed by discharge of the sheets to a stacker 27.

Next, a second embodiment will be explained. The second embodiment involves the adjustment of the position of the side guides 7 for regulating the lateral position of the sheets in the sheet cassette depending on the size of the sheets employed in the cassette. In practice, the sheet loading plate 5 is provided with individual engagement slots 8*a* for engagement with each of a pair of side guides 7, the lateral spacing of the slots 8*a* corresponding to the size width of the sheets. The position of side guides 7 may be changed by engaging and fixing the side guides 7 with the engagement slots 8*a* corresponding to the size of the selected sheet.

Therefore, according to the structure explained above, sheets of various sizes may be used in the sheet cassette by only changing the position of the side guides 7 on the sheet loading plate 5 without replacement of the sheet cassette 1 depending on the size of sheet.

Next, a third embodiment will be explained with reference to FIG. 2 and FIG. 3. The elements, like those in FIG. 1, are designated by like reference numerals and the same explanation is not repeated here.

Figure 2:
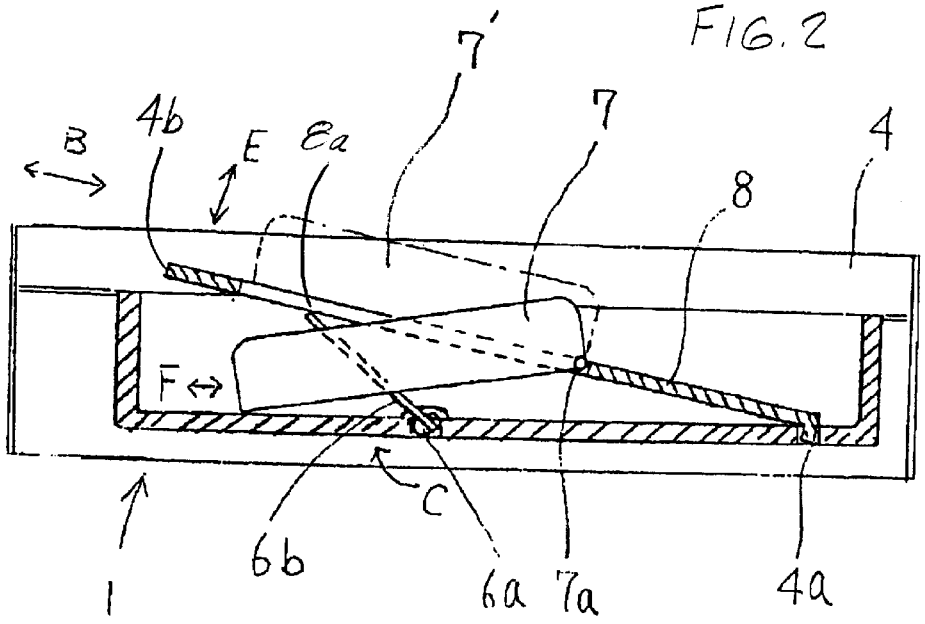
FIG. 2 is a cross-sectional side view taken along the line X—X of FIG. 1.

In FIG. 2 numeral 8 designates a sheet loading plate in which a pair of, or a plurality of pairs of, cutout portions 8*a* are provided depending on the size width of sheets to be supplied between the side guides 7 on the sheet loading plate. On the upstream side in the sheet feeding direction of the cutout portion or slot 8*a*, a bearing means 8*b* is provided to receive a rotating shaft 7*a* provided at one end of each side guide 7 and thereby the side guide 7 is engaged to pivot with respect to the sheet loading plate 8. Numeral 6 designates a lifting mechanism in which a link rod 6*a* is pivoted by a driver (not illustrated) provided within the apparatus body 2 explained in connection with the first embodiment that lifts the sheet loading plate 8 by means of the plate 6*b* at which the end part contains the link rod 6*a* upon rotation of the link rod 6*a*.

Figure 3:
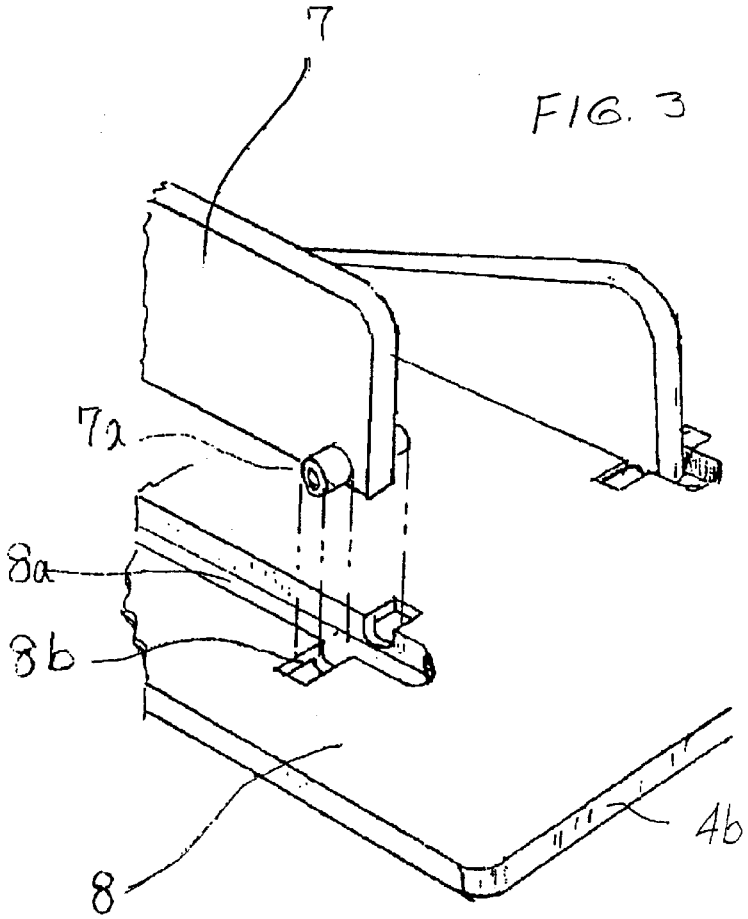
FIG. 3 is a partial perspective view of the sheet loading apparatus of the invention for explaining an enlarged bearing means provided on the rotating shaft of the side guide illustrated in FIG. 2 and the cutout portion of the sheet loading plate therefor.

FIG. 3 is an enlarged perspective view of the rotating shaft 7*a* of the side guide 7 and the bearing part 8*b* provided at an end of the slot 8*a*. The bearing part 8*b* assures easy loading and unloading of the side guides 7 and has a structure in the form of the cutout grooves extending in the width direction with respect to the cutout portion 8*a* in the sheet loading plate 8. A bearing may be used with the rotating shaft 7*a*. When the bearing is used, smooth rotation can be assured. This bearing may also be fixed.

In the above structure, when the sheets loaded on the sheet loading plate 5 are pressed to the feed roller 3 at the time of feeding a sheet, if the shaft 6 of the lifting mechanism is rotated in the direction C by means of the driver provided in the apparatus body, a pressurizing plate 6*b* lifts the sheet loading plate 8. The sheet loading plate 8 is provided to pivot with one end thereof being engaged with the cutout portion 4*a* of the cassette tray 4 and, when the free end 4*b* is lifted by the lifting mechanism 6, the loaded sheet is pressed toward the feed roller 3. In this case, the side guide 7 maintains its height position because the rear ends of the respective sheet guides, being engaged to pivot with respect to the sheet loading plate 8, are lifted together, but the front ends of the sheet guides are not lifted due to their self-weight whereupon they extend through the slots 8*a* to rest on the tray bottom and slide in the direction F as the front end of the plate is lifted.

If a side guide 7 is fixed to the sheet loading plate 8, the side guide reaches the position indicated at 7' by a broken line. But, with the structure explained above, the side guide 7 pivots and is thus projected toward the tray bottom through the slot 8*a* of the sheet loading plate 8 and the upper surface position of the side guide 7 is never projected to a large extent above the upper surface of the sheet cassette 1.

Therefore, according to the structure explained above, even in the case of the image forming apparatus 2 containing a stack of sheet cassettes 1 in many stages, the trouble of catching the side guide 7 of the sheet cassette 1 of a lower stage with the sheet cassette of an upper stage is eliminated.

According to a fourth embodiment of the invention, the position of the side guides 7 to regulate the sheet width of above embodiments may be changed depending on the size of the various sheets. Particularly, a plurality of pairs of slots 8*a* are provided on the sheet loading plate 8 corresponding to various sizes of sheets, and a bearing means 8*b* is provided in each slot to receive the rotating shaft 7*a* of the side guide 7 to change the arrangement position in accordance with the sheet size.

Therefore, owing to the structure explained above, various sizes of sheets may be applied to the sheet loading apparatus by only changing the position of the respective side guides 7 of the sheet loading plate 8 without replacing the sheet cassette 1.

Figure 4:
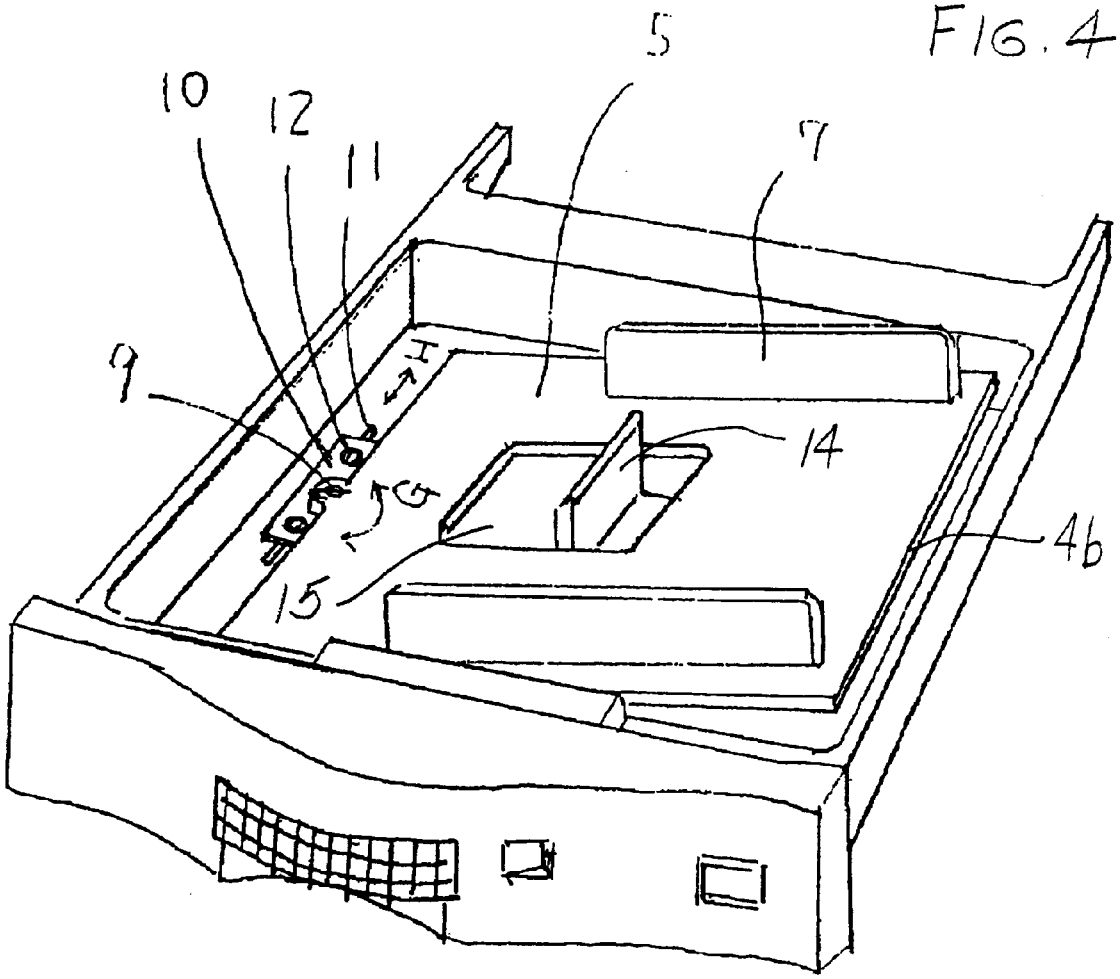
FIG. 4 is aperspective view of the sheet loading apparatus for explaining the angle adjustment and the width direction adjustment of the sheet loading plate of the present invention.

Next, a fifth embodiment of the invention will be explained with reference to the drawings. Numeral 9 designates an angle adjusting mechanism, as illustrated in FIG. 4. This angle adjusting mechanism 9 is structured to adjust, by means of an adjustment screw, the angle in the horizontal direction of the sheet loading plate 5 to ensure discharge of a sheet in a direction so as not to collide with the guide rollers, including resist roller 28, under a skewed condition by adjusting the loading plate 5 or 8 to make the end portion of the sheet loaded on the sheet loading plates 5, 8 parallel to the sheet loading plates and to the resist roller 28 located immediately before the transfer unit 25 of the image forming apparatus 2.

Moreover, the sheet loading plate 5, 8 is capable of pivotally moving in the vertical direction because the free end portion, which may be moved vertically, is lifted by the lifting mechanism 6. The angle adjusting mechanism 9 is provided with a screw which extends through the end portion of the sheet loading plate opposite the free end 4*b* and has an energizing means, such as a biasing spring, around the screw and between the sheet loading plate 5, 8 and cassette tray. Thereby the screw is energized in the direction to move the sheet loading plate downward to the cassette tray.

In the fifth embodiment, if the sheets fed sheet-by-sheet from the sheet loading plate 5, 8 is transferred diagonally with respect to the cassette tray and hence to the resist roller 28, the sheet loading plate can be rotated around the angle adjusting mechanism 9 and an adjustment to prevent the sheet from colliding with the resist roller may be performed by adjusting the transfer angle (G) of the sheet for its passage to the resist roller 28. Thereby, diagonal running of the sheet can be prevented.

Next, a sixth embodiment will be explained with reference to FIG. 4. Numeral 10 designates a width direction adjusting mechanism which can move and adjust the position of the sheet loading plate 5 or 8 in the width direction of the cassette. This width direction adjusting mechanism 10 is composed of a plate for supporting the angle adjusting mechanism 9 and a pair of screws 12 for attaching this plate to an elongated hole or slot 11 provided in the bottom of the cassette tray 4. When the angle adjustment of the sheet loading plate explained in regard to the fifth embodiment is conducted, the center line of the sheet loaded on the sheet loading plate is shifted in some cases in the width direction from the center line of the sheet printing position. Moreover, when the sheet loading position is shifted in the front to rear directions depending on a manufacturing size error between the sheet cassette I and the image forming apparatus 2 and thereby the loading position of sheet cassette 1 is shifted in the front and rear positions because the sheet is fed in a direction from the loading/unloading direction of the sheet cassette 1, the center line of the sheet may be shifted in some cases. When the sheet loading plate center line is shifted in order to solve this problem, the screws 12 of the width direction adjusting mechanism 10 are loosened and the width direction adjusting mechanism 10 is shifted in the sheet width direction (H direction) along the elongated hole 11 and then the screws 12 are tightened again to place the center line of the sheet loading plate in the correct position in the width direction. Therefore, even when the position of the sheets loaded on the sheet loading plate is shifted in the width direction owing to the structure explained above, the sheet printing position can be adjusted by adjusting the position of sheet loading plate by means of the width direction adjusting mechanism 10.

In this embodiment, a printer is described, but the present invention can be equally applied to a sheet cassette which loads sheets, such as documents and recording sheets, to be supplied to an image forming apparatus, such as a copying machine, a facsimile apparatus, or the like.

Therefore, it will be appreciated from the above explanation that the present invention is capable of preventing diagonal running of sheets and of variably setting the lateral position of sheets depending on the sheet size since play does not occur between the sheet loading plate and the width regulating means even if one end of the sheet loading plate is lifted. This advantage is achieved by providing the width regulating means (side guides) directly on the sheet loading plate on which the sheets are loaded.

Since the rear ends of the width regulating means are arranged to pivot with respect to the sheet loading plate, they are projected downward from the sheet loading plate in response to the lifting of the sheet loading plate. Therefore, the rear ends of the width regulating means are never projected upward beyond the upper surface of the sheet loading apparatus (sheet cassette) and the regulating means never obstructs a superimposed sheet cassette when the sheet cassettes are stacked.

Moreover, since adjustment of the fitting angle of the sheet loading plate and its movement in the sheet width direction is possible, it is possible to eliminate adjustment of the rails used for fitting the sheet cassette to the image forming apparatus whereby the adjusting mechanism and the ability to make large adjustments is simplified.

It will be understood that various changes in the details, materials and arrangements of parts, which have been herein described and illustrated in order to explain the nature of the invention; may be made by those skilled in the art within the principle and scope of the invention as expressed in the appended claims.

What is claimed is:

1. Sheet loading apparatus, in which for use with a device having sheet feeding means, comprising:

a tray fittable in said device, a sheet loading plate having a sheet supporting surface disposed in said tray, means for moving said sheet loading plate for pressing sheets supported thereby into operative contract with said sheet feeding means, a width regulating means for regulating lateral positioning of said sheets on said sheet loading plate positioned on said sheet supporting surface and being supported by said sheet loading plate, said width regulating means comprising a pair of laterally spaced guides operative to positionally engage side edges of said sheets positioned on said sheet supporting surface and supported by said sheet loading plate, and means for adjusting the lateral position of said side guides for accommodating sheets of various sizes, and wherein said sheet loading plate is pivotally mounted in said tray for moving said sheet loading plate into contact with said sheet feeding means and said width regulating means comprises a pair of laterally spaced side guides operative to positionally engage side edges of said sheets positioned on said sheet supporting surface of said sheet loading plate, a pair of cutout slots provided in said sheet loading plate for receiving each of said side guides, and means for mounting each said side guide in its associated slot including a pivot connection connecting an end of said side guide upstream of said sheet feeding means, whereby free ends of said side plates project through said cutout slots to a bottom of said tray upon pivotal movement of said sheet loading plate toward said sheet feeding means.

2. Sheet loading apparatus as claimed in claim 1, in which each said side guide has a pivot shaft attached to a lower portion of said end thereof, and a recess for reception of said side guide pivot shaft provided in said sheet loading plate adjacent a forward end of each said cutout slot for pivotal mounting of each said side guide to said sheet loading plate.

3. Sheet loading apparatus as claimed in claim 2, including a plurality of laterally spaced cutout slots provided in said sheet loading plate for selective reception of said pair of side guides for changing the effective position of said width regulating means.

4. Sheet loading apparatus as claimed in any one of claims 1 to 3, including an angle adjusting mechanism having means for connecting said sheet loading plate for pivotal movement with respect to said tray bottom and means for angularly adjusting the position of said sheet loading plate with respect to said mechanism.

5. Sheet loading apparatus as claimed in claim 4, including means for laterally adjusting the position of said angle adjusting mechanism with respect to said tray bottom.

6. Sheet loading apparatus as claimed in claim 5, in which said laterally adjusting means includes an elongated slot provided in the bottom of said tray, and releasable attaching means engaging said slot and securing said mechanism to said tray bottom.

* * * * *